United States Patent [19]

Pletscher

[11] 3,948,003

[45] Apr. 6, 1976

[54] APPARATUS FOR THE TREATMENT OF WORKPIECE SURFACES

[75] Inventor: Oskar Pletscher, Zurich, Switzerland

[73] Assignee: Gebrueder Pletscher, Zurich, Switzerland

[22] Filed: Sept. 25, 1974

[21] Appl. No.: 509,106

Related U.S. Application Data

[62] Division of Ser. No. 226,691, Feb. 16, 1972, Pat. No. 3,848,373.

[30] Foreign Application Priority Data

Feb. 22, 1971 Switzerland ..... 2522/71

[52] U.S. Cl. ..... 51/164

[51] Int. Cl.[2] ..... B24B 31/02

[58] Field of Search 51/164, 316; 241/171, 176–178, 241/181, 183

[56] References Cited

UNITED STATES PATENTS

| | | | |
|---|---|---|---|
| 2,268,661 | 1/1942 | Kennedy | 241/183 |
| 2,425,984 | 8/1947 | Blackman | 51/164 X |
| 2,523,258 | 9/1950 | Ransohoff | 51/164 |
| 2,560,972 | 7/1951 | Martin | 241/183 X |
| 2,680,568 | 6/1954 | Weston | 241/183 X |
| 2,909,335 | 10/1959 | Janelid | 241/183 |
| 2,955,305 | 10/1960 | Jooss | 51/164 X |
| 3,226,044 | 12/1965 | Matsubayashi | 241/181 X |
| 3,401,893 | 9/1968 | Reynolds | 241/171 |
| 3,404,846 | 10/1968 | MacPherson | 241/183 X |

*Primary Examiner*—Al Lawrence Smith
*Assistant Examiner*—Nicholas P. Godici
*Attorney, Agent, or Firm*—Werner W. Kleeman

[57] ABSTRACT

An apparatus for the treatment of workpiece surfaces which comprises means for elevating the particles to a path of free fall for such particles without entraining the workpieces, means for supporting and rotating the workpieces at the region of free fall of the particles, and means for introducing a friction-reducing medium for contact with the workpieces and particles.

23 Claims, 5 Drawing Figures

APPARATUS FOR THE TREATMENT OF WORKPIECE SURFACES

CROSS-REFERENCE TO RELATED CASE

This is a divisional application of my copending commonly assigned U.S. application Ser. No. 226,691, filed Feb. 16, 1972 now U.S. Pat. No. 3,848,373, granted Nov. 19, 1974.

BACKGROUND OF THE INVENTION

The present invention relates to a new and improved apparatus for and method of treating, especially finishing the surfaces of workpiece by means of a mass of smooth-surface or abrasive particles which impinge upon the workpiece surface.

Now, with a finishing method of this general character, typically known in the art under the term "sandblasting", abrasive particles are propelled at high velocity against the workpiece surface to be finished, for instance with the aid of a jet of compressed air. A modified version of this technique uses small pellets or spheres instead of the abrasive particles, these pellets or spheres likewise impinging at high velocity against the workpiece surface. In the last-considered procedure, instead of there being realized the sanding effect produced during sandblasting, a compression and to a certain extent smoothing of the workpiece surface is attained. In both procedures, one is actually concerned with a single-part production technique, the success of which is extensively dependent upon the dexterity of the party performing the work. Under these circumstances it is impossible to realize an economically interesting finishing operation, especially since the increase of the surface quality or fineness, possible only to a limited degree, requires a disproportional increase in the concomitant expenditure of time.

It is also already known in the art to use smooth-surface or abrasive particles during the finishing of workpiece surfaces in a manner different than the previously considered procedures. In particular, in this case the workpiece is embedded in a mass of such particles, the particle mass and the workpiece are then placed into revolving or vibratory motion. To this end, the particle mass and, as a general rule, a number of workpieces are introduced into a rotating vessel closed at both ends and possessing a substantially cylindrical or polygonal cross-section or into a vat-shaped container moved by one or a number of vibrators. Owing to the rotational or vibrational motion, the particles move along the workpiece surface, against which they are pressed by the pressure prevailing within the mass of particles and which is partially attributable to the force of gravity. The workpiece surfaces are correspondingly finished. Also in this case, however, there is a limitation upon the degree of fineness or finishing effect which can be realized within an economically feasible period of time, and just as was the case above, here also the required expenditure of time increases disproportionately with regard to the strived for surface finish quality or fineness. Furthermore, the manipulative steps, namely the filling and emptying of the vessels or containers, is extremely cumbersome and time-consuming, necessitating interruption in production.

Attempts have already been made to bring about a flow of material in vats moved by vibrators. But here also quite a considerable expenditure of equipment is required, especially since this objective only can be realized by complicated multidimensional vibrational motions of the vat housing the particle mass and the workpieces. The specific characteristic of such movements, as for instance path of motion and frequency, are dependent upon the properties of the particle mass and the workpieces. The flow of material which can be realized with this technique is accordingly relatively slow; any attempt to force production causing damage to the workpieces or to poor finish. Moreover, the flow velocity and thus the treatment time for the individual workpieces varies within wide ranges, so that the actually obtained degree of surface finish for a number of workpieces markedly fluctuates. Notwithstanding the flow of material, it is of course to be appreciated that periodic emptying and flushing of the vat cannot be avoided. The treatment of workpieces in vat-like containers which are subjected to shaking or jarring additionally requires a pre-treatment, for instance pickling, oftentimes however also a post-treatment of the workpiece surfaces, and thus brings with it a concomitant problem, the expensive problem of sewage disposal.

SUMMARY OF THE INVENTION

Accordingly, from what has been discussed above, it will be recognized that the prior art is still in need of improved apparatus for and method of treating the surface of workpieces in a manner not associated with the previously discussed limitations and drawbacks of the prior art procedures. It is therefore a primary aim of the present invention to fulfill this objective.

Still a further significant and more specific object of this invention is to provide a new and improved apparatus for increasing the economies in workpiece finishing operations by rapid and intensive treatment of the workpieces until reaching the desired surface quality, and especially devising a procedure conducive for assembly-line production systems with uniform quality of the treated workpieces and hence opening the way for completely automated operations.

Yet a further significant object of the present invention relates to a new and improved apparatus of treating the surfaces of workpieces in an extremely reliable and economical manner, affording uniform surface quality of the treated workpieces.

It is a still further significant objective of the apparatus aspects of this development to provide a surface finishing technique by means of which it is possible to reduce the requisite expenditure in equipment and to avoid any cumbersome and time-consuming operations for carrying out the finishing operations.

Now in order to implement these and still further objects of the invention, which will become more readily apparent as the description proceeds, the method aspects of this development contemplate that the smooth-surface and/or abrasive particles are placed into free fall and while introducing a friction-reducing medium are caused to impact against the workpiece surface.

Whereas in the case of sandblasting and pellet blasting, the particles arrive at the workpiece surface under an artificially increased velocity, in other words, are intentionally subjected to such increased velocity, and wherein the majority of the impacting particles again rebound from such workpiece surface, with the teachings of the method aspects of this development the particles which are in free fall in the direction of the workpiece, even after impinging thereagainst, maintain contact with the impinged workpiece surface. This is particularly the case because the added medium also, in turn, still further reduces the rebound tendency of the particles, which in any event is already slight because the particles are in a state of free fall. Under these conditions, the fall motion of the particles is diverted into a sliding movement along the workpiece surface. While here, just as was the case for sandblasting or pellet blasting, there is also present a compression of the workpiece surfaces, still the effect of the particles is not solely limited thereto, rather, as already stated, there is also present a sliding treating or finishing movement. While the sliding finishing movement can be compared to the procedures which prevail in a rotating vessel or jarred container, still such sliding movement however differs therefrom inasmuch as the particles individually act upon the workpiece surface i.e. free, for instance, from the pressure of the particle mass, also during the so-to-speak sliding working phase.

Notwithstanding the reduced impact velocity during the first working phase and the reduced contact pressure during the second (sliding) working phase there is characteristically realized a considerable increase in surface quality and to a still greater extent a considerable reduction in the momentarily required treatment time. Moreover, not only is there extensively completely prevented workpiece rejects, but furthermore the uniformity of the surface finish during mass production remains within very narrow tolerance ranges, something which could not be heretofore realized. Pre-treatment operations are not necessary, in fact workpieces having a slight adhering oil film, for instance compression molded parts with adhering mold separation oil, can be subjected to the described process without requiring pre-cleaning. By virtue of the described action of the particles, which can be considered in terms of the impact phase and the sliding phase, it is possible to work with a reduced mass of such particles. One possible explanation for this is that the individual particles remain effective much longer during the subsequent sliding phase then if they were merely permitted to impact, whereby the work pressure required in the aforementioned sliding phase need not be produced with the aid of a sluggish mass of mutually frictionally contacting but otherwise inactive particles, rather, owing to the fall motion and the introduced friction-reducing medium, this work pressure is derived from the reboundless impact of the particles against the work surface. In fact, during the reboundless deflection of the falling movement of the particles into a sliding movement, there prevails the required surface compression during the sliding phase.

As already indicated above, not only is this invention directed to the above-discussed method aspects but also deals with apparatus for the performance of the aforedescribed method. Such apparatus is generally manifested by the features that there is provided means for elevating or lifting the particles to a path of fall without lifting the workpieces to bring about a separation action between the particles and workpieces, means for supporting and rotating the workpieces within the fall range of the particles, said supporting and rotating means incorporating said particle elevating means, and means for introducing the friction-reducing medium. It is possible for the discharge of a particle elevating or lifting mechanism to be arranged at one end and the inlet of such elevating mechanism at the other end of a receiving device designed to support and rotate the workpieces. One advantageous constructional manifestation of the invention employs a substantially tubular-shaped shell or drum which rotates about an at least approximately horizontal axis. This shell is provided at its inner surface with entrainment means for the particles and at the same time also forms a trough for receiving the medium, for instance a liquid lubricant or lubricating agent. The particles which are continuously raised by the shell, after they have moved through a certain angular rotation, drop downwardly onto the workpiece or workpieces located at the lower region of the shell and owing to shell rotation the workpiece or workpieces are continuously turned or rotated, so that there is realized an imbuing of the workpiece surface by the lubricant also located at this region of the shell. By inclining the axis of the shell or drum with regard to the horizontal, the workpieces which are rolling upon the inner surface of the shell at its lower region or supporting surface have imparted thereto a feed or advancing movement so that they travel through such shell and depart at the lowermost situated end thereof. In fact, it is possible to imagine that the movement of such workpieces contained in the shell extends in the axial lengthwise direction thereof and possibly in a spiral-like twisting fashion down the length of such shell.

The feed velocity and thus the treatment time is a function of the inclination of the shell or drum. Consequently, there is realized a line-production system or assembly-line production which can be carried out practically without interruption. In any case, cleaning of the equipment at the end of a work day or at the end of a work week can be performed most simply. Since the particles distribute over the entire length of the shell or drum, obviously at the lower end of the shell a number of such particles depart, but the outflowing quantity is relatively slight so that their return or recirculation back into the upper end of the shell only requires very little expenditure.

A further aspect of the development of this invention relates to a preferred use of the previously described inventive method for polishing the surfaces of workpieces with the use of spherical or sphere-like particles or pellets.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figures 1, 2, 3, 4, 5:
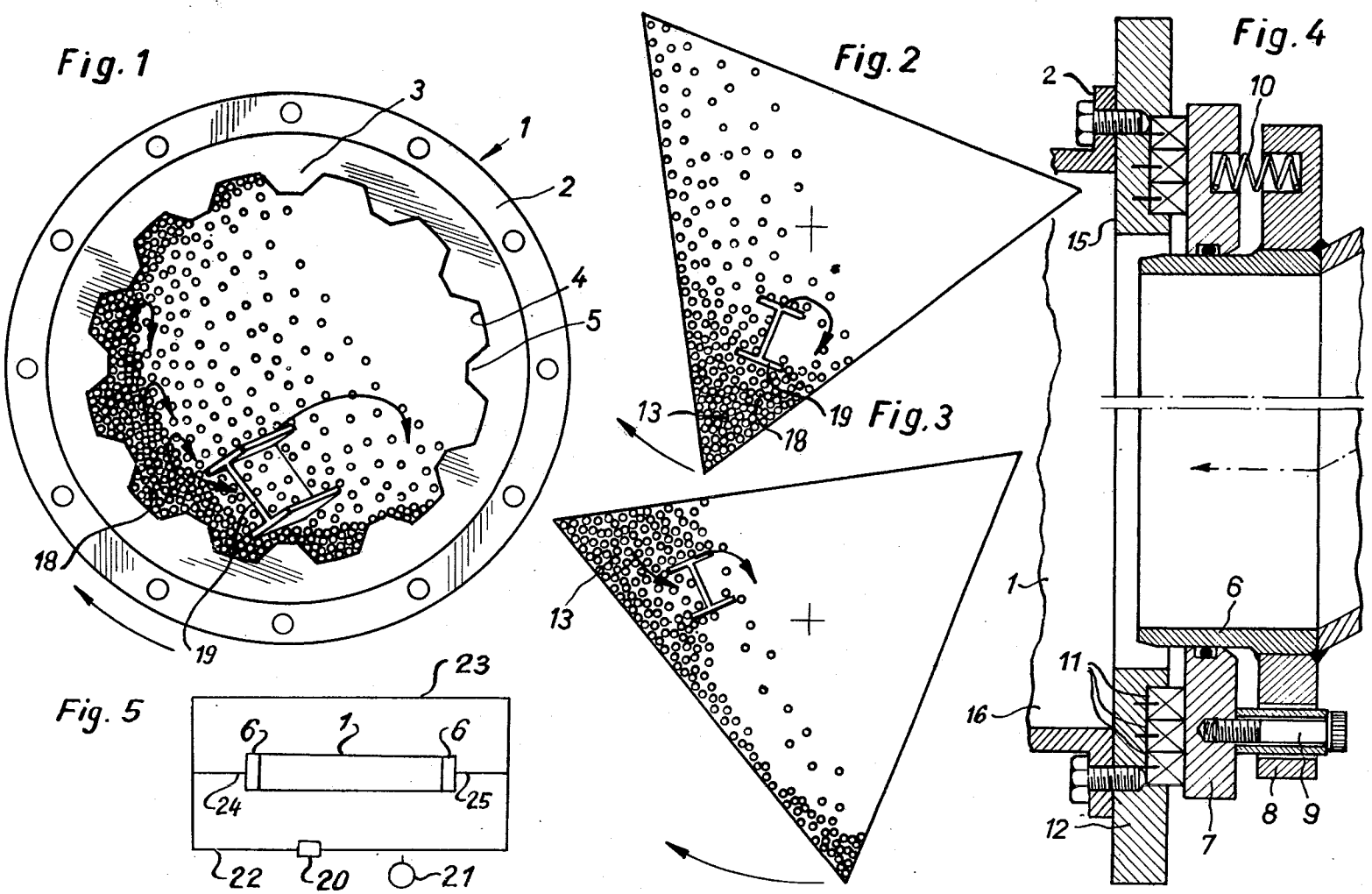
FIG. 1 illustrates an end face of a cylindrical shell or drum of the inventive workpiece treatment equipment, the remaining structure of which has not been depicted in FIG. 1, and which end face would be seen upon removal of the infeed mechanism.
FIG. 2 schematically illustrates the end face of a prismatic shell or drum which in cross-section is triangular-shaped, the remaining details of the finishing equipment also having not been particularly illustrated in this FIG.
FIG. 3 illustrates the shell construction of FIG. 2 in a different rotational position.
FIG. 4 is an axial sectional view through the infeed mechanism which can be coupled with the end face of the shell or drum of FIG. 1.
FIG. 5 is a schematic view illustrating further details of the inventive treatment equipment.

Considering now the drawings, it is to be understood that only enough of the construction of the workpiece treatment equipment designed according to the teachings of this invention considered important for understanding the underlying concepts has been disclosed in the drawings in order to simplify the illustration. Hence, by referring now more specifically to FIG. 1 the cylindrical shell or drum, designated in its entirety by reference numeral 1, is hidden behind a flange 2 which, just as the case for the flange mounted at the other end of the shell 1 and which is not visible in the illustration of FIG. 1, serves to connect together the shell with a number of such units and with an end closure mechanism. In a manner well known to the art the shell or drum 1 is rotatably mounted upon support rolls for revolving movement about its own axis, and specifically advantageously in such a manner that the shell axis is inclined with regard to the horizontal as previously considered. The inner surface of the shell 1 is lined with a coating or covering 3 formed of rubber, plastic, wood or some other suitable material, this covering 3 being provided with a rib or grooving arrangement extending approximately in the lengthwise direction of the shell 1 and formed by the depressions in the form of grooves or troughs 4 and the raised portions in the form of ribs or protruberences 5 for instance.

The infeed end of the shell arrangement which, as stated, can be assembled together from a number of such shell sections, has arranged in front thereof an infeed mechanism of the type depicted in greater detail in FIG. 4. This infeed mechanism comprises an angled or flexed infeed pipe or conduit 6 which is stationarily fixed in any suitable way, such angled infeed conduit 6 engaging with play into the neighboring end of the shell 1 enclosed by the shell flange 2. The infeed conduit 6 carries a contact or slip ring 7 which surrounds such infeed conduit 6. Now this contact ring 7, with the aid of screws 9 (only one of which is visible in the drawing) piercingly extending through a flange 8 of the infeed conduit 6, is likewise fixedly retained against rotation. Further, by means of compression springs 10 circumferentially distributively mounted between the contact ring 7 and the flange 8 this contact ring is sealingly pressed against a sealing flange 12 secured to the flange 2 of the shell 1 and which sealing flange 12 equipped with sliding seals 11. In this connection attention is invited to FIG. 4. Such infeed mechanism forms at the region of the neighboring end face of the shell 1 an annularor ring-shaped, inwardly projecting rib 15 which readily permits the entry of the workpieces 19. At the discharge end of the shell 1 there is likewise arranged an entrainably rotated ring-shaped rib formed for instance of an arrangement similar to that of FIG. 4. Owing to the ribs 15 provided at both ends of the shell 1 the latter forms a tub-like trough or vat 16 (FIG. 4) for the reception of the friction- reducing medium, for instance in the form of a liquid lubricant which, as also is the case for the particles 18, distributes itself throughout the entire length of the shell.

Owing to the rotation of the shell, assumed in the present case to be in the clockwise direction, the particles which may be in the form of spheres, pellets, stones, granulates, or so forth, are upwardly entrained through a certain angle of rotation by the entrainment means formed by the grooves 4 and the ribs 5 —which in the exemplary embodiment together with the shell form a particle elevating or lifting means—, and specifically as a function of the properties of the inner grooving and rib arrangement of the shell, the magnitude or size of the particles and the centrifugal force acting upon such particles. The workpieces are also entrained by the shell, specifically by the aforedescribed grooving and rib arrangement, however only to a relatively slight degree, since after traveling through a small angular rotation these workpieces will roll or tumble back down. In this way the workpieces 19 are subjected to a continuous revolving or turning movement always at the lower region or lower supporting surface of the shell, —which also constitutes the particle inlet region to the said lifting means—so that they are subjected to the falling stream of particles which descend from the top towards the bottom of the shell, the upper or top shell region essentially defining the discharge location for the particles from the particle lifting or elevating means. The drawing illustrates the presence of such falling particle stream which encompasses a considerable proportion of the inner width of the shell and which treats or finishes the surface of the workpieces from all sides in the already described manner. Of course, contact of the workpieces with the particles located at the lower region of the shell 1 also contributes to the treatment or finishing effect inasmuch as there is present the continuous rolling back of the workpieces 19 upon the actual bed formed by the particles 18. In this connection the friction-reducing medium which contacts the particles 18 and the workpieces 19 also plays a considerable role. With the axis of the shell inclined with regard to the horizontal the workpieces additionally experience a progressive feed or advancing movement in the direction of the lowermost or lower situated end of the shell 1 until they depart in a finished processed or treated condition from the just-mentioned location of the shell. The feed velocity is, of course, among other things a function of the angle of inclination.

Now with respect to the construction of the shell it is to be understood that numerous possibilities exist. It is only important for the entrainment of the particles 18 to undertake measures which ensure for a certain angle of rotation so that there is formed a falling stream of particles. Of course, it should be apparent that care should be taken to ensure that the workpieces 19 are always subjected to this stream of particles 18 at all sides, in other words rotated or turned. When taking into account these conditions the shell simultaneously forms a lifting or elevator mechanism for the particles as well as a receiving mechanism for rotating and holding the particles below the particle outlet or discharge end of the lifting mechanism, and finally also a lubricating mechanism which ensures for the introduction of the friction-reducing medium. A shell having an inner polygonal cross-sectional configuration is basically readily in a position to fulfill these functions, and such construction of shell has been depicted in FIGS. 2 and 3.

Now in the rotational position of the shell disclosed in FIG. 2, and which as illustrated possesses in cross-section a prismatic shell structure of triangular shape, the majority of the particles and the workpiece, for the illustrated rotational position of such shell, are located at the lowermost situated apex or corner of the shell body. On the other hand, as illustrated in FIG. 3, the particles which were entrained by the apex or corner of the shell body which was moved upwardly, and now is located at the upper or topmost region of the shell, rain or stream down upon the workpiece. During rotation of the shell depicted in FIG. 2 in the clockwise direction, the lowermost situated apex or shell body corner, designated by reference character 13 in such FIG. 2, while entraining the particles entrapped therein and while also upwardly entraining to a certain degree the workpieces 19, as best seen by referring to FIG. 3, travels upwardly. Consequently, a portion of the particles 18 and the workpiece 19, while in mutual contact with one another, soon again slide downwards and then subsequently are exposed to the stream of the remaining particles, in the manner best recognized by referring to FIG. 2. Also with this constructional form of equipment the mode of operation described in conjunction with FIG. 1 is completely realized.

Finally, FIG. 5 schematically illustrates the workpiece treatment or finishing equipment of this invention embodying the shell construction 1 provided at its closed ends with mechanism of the type substantially depicted in FIG. 4 including the flexed or bent pipe arrangements, conveniently indicated by reference character 6 in FIG. 5 at the inlet side 25 and the outlet side 24 of such shell construction. The particles which depart from the outlet side or end 24 of the treatment equipment are recycled by means of the conveying or feed pump 20, the suction side of which communicates via the conduit 22 with such outlet side of the equipment. Further, any losses in the liquid medium can be made-up by a suitable dosing pump 21, for instance operating intermittently or continuously as a function of time, this dosing pump 21 feeding its make-up liquid into the main stream of recycled medium conveyed back by the feed pump 20 to the inlet side 25 of the equipment. The dosing pump 21 is especially then useful when working with a multi-component medium, such pump serving to make-up the required supply of at least one of the medium components. Finally, the particles leaving the outlet side or end 24 of the system also can be recycled in any convenient fashion through for instance the schematically indicated conveyor or conduit system 23 back to the inlet side 25 of the system.

Treatment or finishing equipment of the previously described type appear at first blush to differ only slightly from the previously mentioned rotating vessels. Yet a closer inspection and comparison will in fact reveal quite significant differences. The heretofore known rotating vessels are always at least one-half filled with particles since their principle of operation is based upon the fact that such a large particle mass, subjected to its inherent pressure, is continuously turned or circulated with the workpieces embedded in such mass of particles. Hence, the vessels or containers must be closed at both ends, thus precluding any assembly-line production, and as should be recalled is significantly possible when practicing the teachings of this invention. This is so because with the inventive development the rotating shell is not used at all as a container for the reception and circulation of a large mass of particles, rather is employed to carry out a multiplicity of functions in the form of a lifting or elevator mechanism for producing a free falling stream of particles, as a receiving mechanism or receiver for the rotatable support of the workpieces, and finally as a mechanism for receiving and delivering the medium, none of which functions are inspired by or derived from the concepts of the state-of-the-art rotating vessels or containers. Notwithstanding a superficial outward similarity the prior art rotating vessels and the treatment equipment of this invention are basically and fundamentally different, particularly as concerns their construction, mode of operation and cooperative interrelationship of the hardware.

The medium may contain a cleaning agent and can be preferably utilized in a liquid state. As already mentioned above, losses, for instance owing to entrainment of quantities of the medium adhering to the workpieces, by vaporization, and so forth, can be intermittently or advantageously continuously made-up by the introduction of the medium to the infeed end of the shell. This can of course occur to such a degree that there is realized an intensified throughflow of medium through the shell, whereby the inherent selfcleaning effect present in such equipment is further intensified. This leads to dispensing with the previously mentioned more expensive and frequent cleaning operations. As also previously discussed in connection with FIG. 5 the medium as well as also the particles can be recycled back to the inlet end of the shell. During continuous recycling or return of the medium, its composition can be controlled and maintained constant, for instance with the aid of suitable dosing pumps controlled as a function of time or in another suitable manner, as exemplified by the dosing pump 21 of FIG. 5. The relatively small requirement of particles which actively participate in the working process generally leads to a considerable saving in drive power requirements, in particular however also when carrying out the aforediscussed recycling operation. The medium can contain additives having special functions and for realizing special effects, for instance dying, dull finishing, just to mention a few. When working with a liquid medium there is advantageously admixed an agent, for instance, silicone, for preventing the formation of foam, and if desired, also an emulsifying agent.

While there is shown and described present preferred embodiments of the invention, it is to be distinctly understood that the invention is not limited thereto but may be otherwise variously embodied and practiced within the scope of the following claims. ACCORDINGLY,

What is claimed is:

1. An apparatus for treating the surface of workpieces by means of a mass of smooth-surface or abrasive particles which impact against the surface of the workpiece, comprising means for elevating the particles to a path of free fall for such particles without appreciably entraining the workpieces, means for supporting and rotating the workpieces at the region of free fall of the particles, said supporting and rotating means incorporating said particle elevating means, said elevating means including entrainment means for predominantly only entraining and elevating said particles without appreciably entraining and raising said workpieces to thereby continually produce a separation action between the particles and the workpieces, the particles being elevated to said path of free fall to form a freefalling stream of particles raining down and impacting against the workpieces whereas the workpieces during said separation action being simultaneously exposed to a tumblind action and being freely rotatable at the region of a lower actuated supporting surface of said supporting and rotating means, said means for supporting and rotating the workpieces comprising a slightly inclined receiving mechanism substantially open at both ends, said supporting surface extending between said open ends, and means for introducing a friction-reducing medium for contact with the workpieces and particles.

2. The apparatus as defined in claim 1, wherein said means for supporting and rotating the particles includes a particle infeed region and a particle outfeed region, said particle outfeed region being disposed at a lower end of said receiving mechanism and said particle infeed region being disposed at an upper end of said receiving mechanism.

3. The apparatus as defined in claim 2, wherein said receiving mechanism comprises a shell revolving about an at least approximately horizontal axis, said shell having an inner surface equipped with said entrainment means, and said shell including means providing a tub-like trough means for receiving the friction-reducing medium.

4. The apparatus as defined in claim 3, wherein said shell possesses a substantially cylindrical configuration.

5. The apparatus as defined in claim 3, wherein said shell possesses a substantially polygonal cross-sectional configuration.

6. The apparatus as defined in claim 3, wherein the inner surface of the shell is selectively provided with raised portions, depressions, or both, for entraining the particles and defining said entrainment means.

7. The apparatus as defined in claim 3, wherein said shell is provided at its inner surface with closely arranged groove means extending approximately in the lengthwise direction of the shell and defining said entrainment means, said groove means being of a size to receive the particles but insufficient in size to receive the workpieces.

8. The apparatus as defined in claim 7, further including a liner provided for said shell and equipped with said groove means.

9. The apparatus as defined in claim 3, wherein the inner surface of said shell is provided with groove means extending approximately in the lengthwise direction of said shell and defining said entrainment means, said inner surface of said shell and the surface of said entrainment means being formed of a material selected from wood, plastic, rubber or a rubber-like material.

10. The apparatus as defined in claim 7, wherein said shell has end portions, and means defining a respective substantially ring-shaped inwardly directed rib provided at the region of each of the end portions of the shell.

11. The apparatus as defined in claim 10, wherein said shell has an infeed end, and one of said ring-shaped ribs is stationarily arranged at said infeed end, and sliding seal means for sealing said stationarily arranged ring-shaped rib towards the neighboring infeed end of the shell.

12. The apparatus as defined in claim 1, wherein said rotating and supporting means comprises a shell having an infeed end and a discharge end, said means for introducing the friction-reducing medium comprises feed means for introducing a liquid friction-reducing medium into said infeed end of the shell.

13. The apparatus as defined in claim 12, wherein said feed means includes a feed pump having its suction side connected with said discharge end of the shell.

14. The apparatus as defined in claim 12, wherein when using a multi-component medium there is provided a dosing pump for at least one of the components.

15. Apparatus for treating the surfaces of workpieces by means of smooth surface or abrasive particles, comprising a substantially open-ended tubular container capable of receiving the workpieces, the particles and a friction reducing medium therein, said container being rotatable about its longitudinal axis and having its axis inclined with respect to the horizontal such that one of said containers ends is raised with respect to the other end and constitutes an infeed region for said workpieces and the other end constitutes an outfeed region for said workpieces, the inner surface of said container being provided with or forming means for the entrainment and raising of said particles when said container is rotated in operation of the apparatus such as to lift particles when in said container and thereby place said lifted particles in the state of a free falling stream of particles and allow the workpieces to rotate freely, said entrainment means substantially only entraining and elevating said particles without appreciably entraining and raising said workpieces in order to thus produce a separation action between the particles and the workpieces, the particles being elevated to a position permitting said free falling stream of particles to rain down and impact against the workpieces whereas the workpieces during the separation action being simultaneously exposed to a tumbling action during the time that the workpieces freely rotate at the region of a lower situated supporting surface of the container, and the space within said container being such that the free falling stream of particles is not interrupted after leaving said entrainment and raising means until the free falling stream of particles impinges on the workpieces.

16. The apparatus as claimed in claim 15, wherein said container comprises means forming the container into a tub-like trough for receiving the friction-reducing medium.

17. The apparatus as claimed in claim 15, wherein said container possesses a substantially cylindrical configuration.

18. The apparatus as claimed in claim 15, wherein said container possesses a substantially polygonal cross-sectional configuration.

19. The apparatus as claimed in claim 17, wherein the inner surface of the container is selectively provided with raised portions, depressions, or both, defining said entrainment means for entraining and raising the particles.

20. The apparatus as claimed in claim 17, wherein said container is provided at its inner surface with grooves extending approximately in the lengthwise direction of the container for entraining and raising the particles.

21. The apparatus as claimed in claim 15, wherein the inner surface of said container is provided with grooves extending approximately in the lengthwise direction of said container, for entraining and raising the particles and defining said entrainment means, said inner surface of said container and the surface of said entrainment means being formed of a material selected from wood, plastics, rubber or rubber-like material.

22. The apparatus as claimed in claim 15, wherein the container end portions each have a substantially ring-shaped inwardly directed rib forming the container into a tub-like trough.

23. The apparatus as claimed in claim 15, wherein said particles comprise ball-like members.

* * * * *